US006832739B1

(12) United States Patent
Kraus

(10) Patent No.: US 6,832,739 B1
(45) Date of Patent: Dec. 21, 2004

(54) PAPER TOWEL HOLDER

(76) Inventor: Peter B. Kraus, 18115 NE. 92nd Ave., Battle Ground, WA (US) 98604

( * ) Notice: Subject to any disclaimer, the term of this patent is extended or adjusted under 35 U.S.C. 154(b) by 0 days.

(21) Appl. No.: 09/947,490

(22) Filed: Sep. 5, 2001

(51) Int. Cl.[7] ..... B65H 23/06
(52) U.S. Cl. ..... 242/422.5; 242/597.7
(58) Field of Search ..... 242/597.7, 422.5, 242/422.6

(56) References Cited

U.S. PATENT DOCUMENTS

| | | | | |
|---|---|---|---|---|
| 2,503,051 A | * | 4/1950 | Jeckert et al. | 242/422.5 |
| D161,985 S | | 2/1951 | Woodworth | |
| 2,917,249 A | | 12/1959 | MacLelland | |
| 3,806,057 A | | 4/1974 | Whatley | |
| 4,012,007 A | | 3/1977 | Cunningham | |
| 4,030,676 A | | 6/1977 | Bardsley | |
| 4,487,376 A | | 12/1984 | Compton | |
| 4,535,947 A | | 8/1985 | Hidle | |
| 4,535,948 A | | 8/1985 | Gillen | |
| 4,600,162 A | | 7/1986 | Hidle | |
| 4,741,486 A | | 5/1988 | Ancona et al. | |
| D326,580 S | | 6/1992 | Brazis | |
| 5,149,003 A | | 9/1992 | Tharp | |
| 5,167,377 A | * | 12/1992 | Chalmers | 242/597.7 |
| 5,292,083 A | | 3/1994 | Ridenour | |
| 5,297,750 A | | 3/1994 | Hunt | |
| 5,311,986 A | | 5/1994 | Putz | |
| 5,605,304 A | | 2/1997 | Ahern | |
| 5,727,750 A | | 3/1998 | Kelly | |
| 5,878,976 A | | 3/1999 | Duck | |
| 5,950,961 A | | 9/1999 | Duck | |
| 6,302,348 B1 | * | 10/2001 | Lillelund | 242/597.7 |

OTHER PUBLICATIONS

Catalog, "Rue De France", p. 28, published before Sep. 5, 2001.
Catalog, "Crate&Barrell", p. 40, published before Sep. 5, 2001.
Catalog, "Touch of Class", p. 41, published before Sep. 5, 2001.
Catalog, "Expressions", p. 33, published before Sep. 5, 2001.

* cited by examiner

*Primary Examiner*—John Q. Nguyen
(74) *Attorney, Agent, or Firm*—Kurt M. Rylander

(57) ABSTRACT

A support for conventional roll of perforated paper toweling includes a base for mounting on a vertical or horizontal surface, a support rod perpendicular to said base for holding the towel roll, and a pressure member insertable into one of a plurality of insertion holes in said base for contacting a conventional roll of perforated paper to impede the unrolling of the towels when one is being torn off the roll.

7 Claims, 2 Drawing Sheets

10
12
14
16
18
20
22
24
26
T

PAPER TOWEL HOLDER

FIELD OF THE INVENTION

The present invention relates to paper towels and dispensers for paper towels, and more particularly to paper towel dispensers holding a roll of paper towels.

The subject invention relates generally to holders for rolled sheet products and, specifically, to holders for retaining and dispensing a paper towel roll.

BACKGROUND

Devices for supporting a conventional roll of paper towels are numerous. Paper towel dispensers are well known consumer products. Typically such dispensers are wall mounted and comprise a back panel and spaced apart arms extending outward from opposite ends of the back panel. The arms of different dispensers accommodate receipt of paper towels in roll form there between in a different ways. One commercial dispenser has arms that pivot outward to receive a towel roll, and then pivot inward to capture the roll with ends of the arms having lugs that fit into the core of the towel roll, providing pivot pins about which the roll can rotate. Another approach teaches the incorporation of spring biased lugs mounted into the ends of the dispenser arms. The lugs recess inwardly as the towel roll is inserted there against and, when the roll is at its final position, the lugs eject outward and into the roll core. The roll can then rotate about the lugs as individual sheets of paper are withdrawn.

With existing paper towel dispensers, the problem exists that, with the paper towel in the dispenser, as the roll gets used, and the diameter of the roll reduces, it no longer pushes against the holder rail with sufficient pressure, and the end of the roll comes loose.

The following represents a list of known related art:

U.S. Pat. No. 4,487,376 issued to Compton, Dec. 11, 1984;

U.S. Pat. No. 5,297,750 issued to Hunt, May 29, 1994;

U.S. Pat. No. 5,605,304 issued to Ahern, Feb. 25, 1997;

U.S. Pat. No. 4,030,676 issued to Bardsley, Jun. 21, 1977;

U.S. Design Pat. No. 161,985 issued to Woodworth, Feb. 13, 1951;

U.S. Pat. No. 4,012,007 issued to Cunningham, Mar. 5, 1977;

U.S. Pat. No. 4,487,376 issued to Compton, Dec. 11, 1984;

U.S. Design Pat. No. 326,580 issued to Brazis, Jun. 2, 1992;

U.S. Pat. No. 5,149,003 issued to Tharp, Sep. 22, 1992;

U.S. Pat. No. 5,727,750 issued to Kelly, Mar. 17, 1998;

U.S. Pat. No. 5,311,986 issued to Putz, May 17, 1994;

U.S. Pat. No. 5,292,083 issued to Ridenour, Mar. 8, 1994;

U.S. Pat. No. 5,878,976 issued to Duck, Mar. 9, 1999;

U.S. Pat. No. 5,950,961 issued to Duck, Sep. 14, 1999;

U.S. Pat. No. 4,741,486 issued to Ancona et al., May 3, 1988;

U.S. Pat. No. 4,600,162 issued to Hidle, Jul. 15, 1986;

U.S. Pat. No. 4,535,948 issued to Gillen, Aug. 20, 1985;

U.S. Pat. No. 4,535,947 issued to Hidle, Aug. 20, 1985;

U.S. Pat. No. 3,806,057 issued to Whatley, Apr. 23, 1974;

U.S. Pat. No. 4,030,676 issued to Bardsley, Jun. 21, 1977; and

U.S. Pat. No. 2,917,249 issued to MacLelland, Dec. 15, 1959.

The teachings of each of the above-listed citations (which does not itself incorporate essential material by reference) are herein incorporated by reference. None of the above inventions and patents, taken either singularly or in combination, is seen to describe the instant invention as claimed.

SUMMARY AND ADVANTAGES

A paper towel holder is provided that comprises a flattened base, a support rod connectable to said base and insertable through the core of a conventional paper towel role, and a pressure member connectable to said base at any one of a plurality of pressure member insertion holes in said base, wherein the pressure member is for making contact with said paper towel roll and impeding the loose unrolling of the paper towels on said roll. Paper towel holder can be used freely located on a horizontal countertop, or alternatively can be wall mounted. Base can optionally be provided with gripping legs, preferably formed of silicone material, attachable to the undersurface of base to help prevent slipping on a counter surface. The base and the support rod are separable for packing and storage for efficient and economical packaging for sale and/or storage when disassembled.

A paper towel holder according to the invention disclosed herein has numerous advantages. Advantage obtains from being able to keep the loose paper towel end of a conventional paper towel roll from flapping freely on a holder. Advantage obtains from having an easily assembled and disassembled paper towel holder for ease of sale and/or storage. Advantage obtains from having a paper towel holder that can be mounted on the wall or left free standing on a horizontal countertop.

Additional advantages of the invention will be set forth in part in the description which follows, and in part will be obvious from the description, or may be learned by practice of the invention. The advantages of the invention may be realized and attained by means of the instrumentalities and combinations particularly pointed out in the appended claims. Further benefits and advantages of the embodiments of the invention will become apparent from consideration of the following detailed description given with reference to the accompanying drawings, which specify and show preferred embodiments of the present invention.

DETAILED DESCRIPTION

Before beginning a detailed description of the subject invention, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy.

Figures 1, 2, 3:
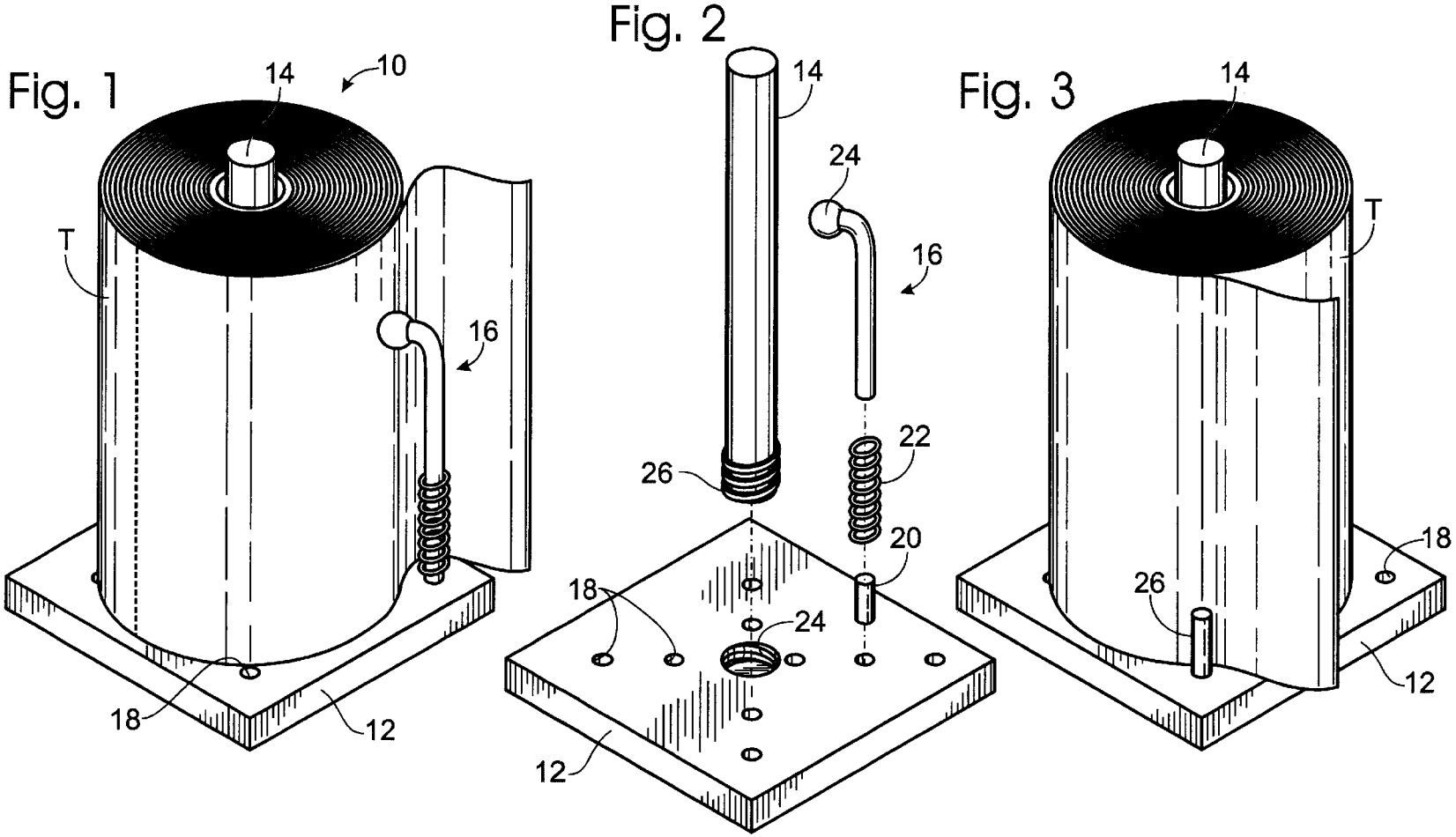
FIG. 1 shows an embodiment of the present invention.
FIG. 2 shows a exploded view of the embodiment of the present invention shown in FIG. 1.
FIG. 3 shows another embodiment of the present invention.

A paper towel holder is provided. Referring to FIG. 1, a paper towel holder 10 is shown as it would be used on a horizontal countertop or other such horizontal surface. Paper towel holder according to the present invention is shown, in use, comprising a flattened base 12, a support rod 14 extending perpendicularly from the approximate center of the base, and a removable pressure member 16 extending perpendicularly from any one of a plurality of insertion holes 18 in said base. A paper towel roll T is supported on the support rod. The holder is adapted for use on a horizontal surface or may be mounted with screws on a vertical wall such that the towel roll T is perpendicular to the vertical surface.

Figure 6:
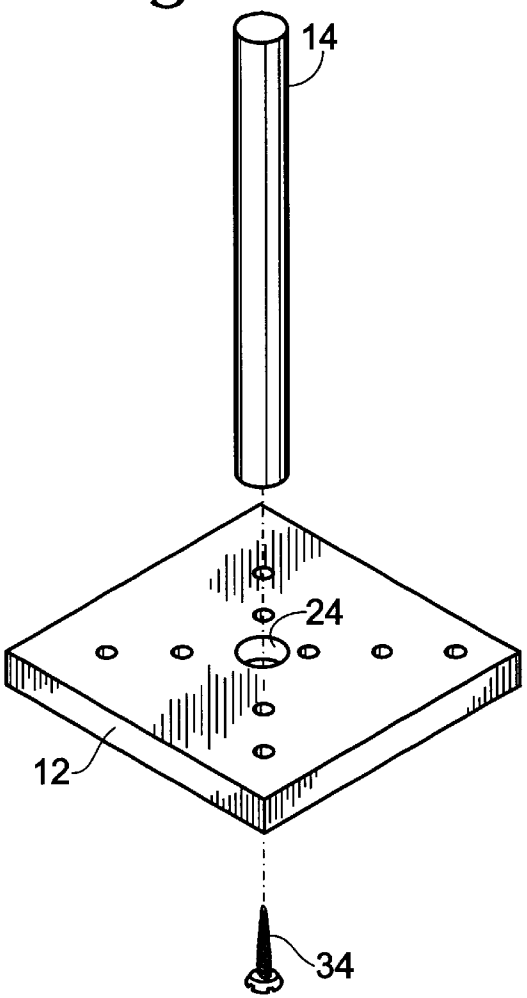
FIG. 6 shows the base and support rod of FIG. 1 attached with a screw or friction fitted.
Figure 5:
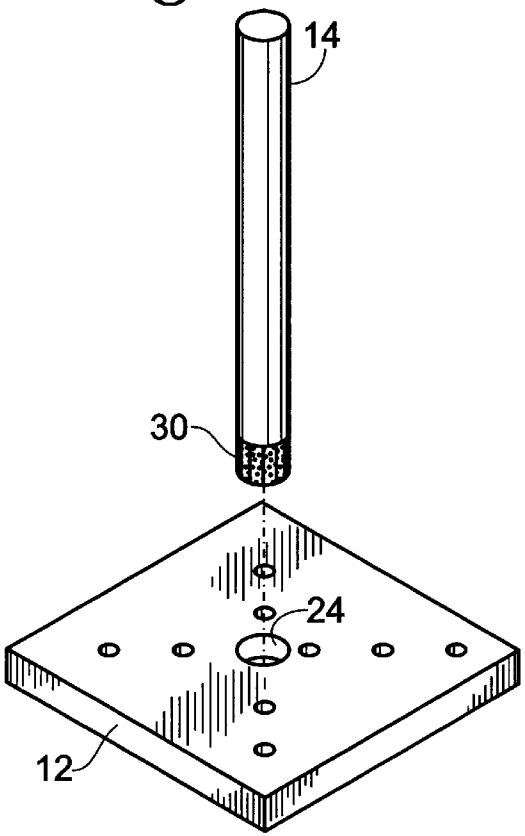
FIG. 5 shows the base and support rod of FIG. 1 attached with glue.
Figure 4:
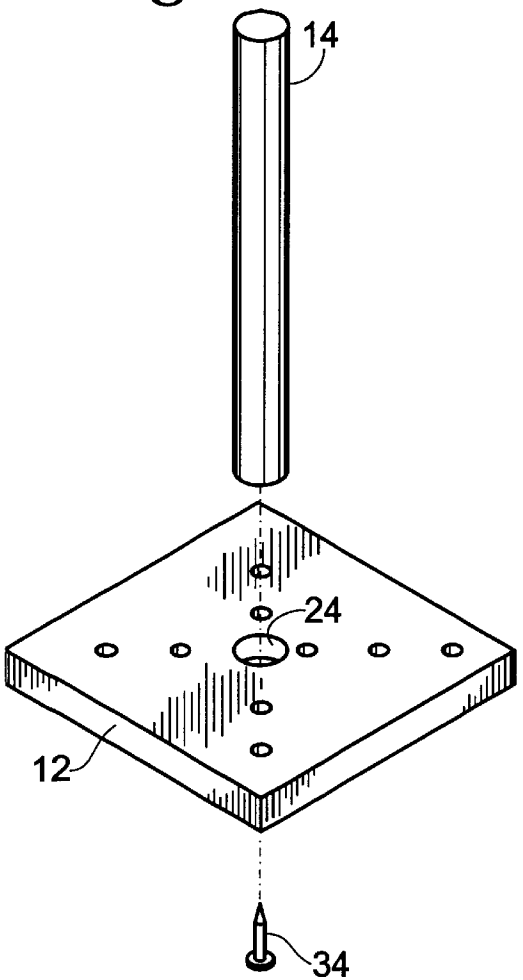
FIG. 4 shows the base and support rod of FIG. 1 attached with a nail or friction fitted.

In the preferred embodiment, support rod 14 is made of wood. Support rod can be made of other suitable materials, including steel, plastic, and metal, to name a few. As shown in FIG. 2, the base and the support rod are separable for packing and storage. In the preferred embodiment rod includes a threaded lower end which screws into a threaded aperture in the center of base. As seen in FIGS. 4–6, other conventional means for attaching the rod to the base include metal screws 34, bolts, glue 30, etc. Alternatively, center aperture of base can be unthreaded, and rod can be loosely friction fit into center aperture. See FIGS. 4 and 6 without the nail and screw. In the preferred embodiment, center aperture is formed by tool drilling. Center aperture can also be formed during the molding process, and other tooling processes, to name a few. By having separable components the holder is compact for efficient and economical packaging for sale and/or storage when disassembled.

The base 12 includes a flat undersurface. As previously mentioned, the base has an outer diameter greater than the diameter of the towel roll T. Support rod is insertable through paper towel roll T. In the preferred embodiment, base is made of wood. Base can be made of other suitable materials, including steel, plastic, and metal, to name a few. Base can be provided with gripping legs (not shown), attachable to the undersurface of base to help prevent slipping on a counter surface. The gripping legs are preferably formed of a silicone material which is particularly effective at gripping a smooth surface such as a cabinet or countertop. If it is desired to mount the holder on a wall or other vertical surface, the base is mounted with screws or nails through apertures to the desired wall or surface. Operation of the holder is otherwise the same.

Base is provided with a plurality of insertion holes 18 into which pressure member 16 is inserted. Insertion holes are provided at varying distances between center aperture of base and the edge of said base. In preferred embodiment, insertion holes spiral outward from a point near the center of the stand to the edge of the base. In the preferred embodiment, insertion holes are threaded apertures into which pressure member provided with a threaded lower end can be screwed. Alternatively, insertion holes can be unthreaded, and pressure member lower member can be loosely friction fit into insertion holes. In the preferred embodiment, insertion holes are formed by tool drilling. Insertion holes can also be formed during the molding process, and other tooling processes, to name a few.

Pressure member 16 is initially in one of the outermost insertion holes closest to the outer edge of the roll T. As the roll gets used, and its roll diameter diminishes, the insertion member is removed, and inserted into the next inward insertion hole closest in proximity to the outer edge of the roll T. In the preferred embodiment, pressure member has a insertion portion 20, a spring portion 22, and a contact portion 24. Insertion portion connects to said base at said insertion holes. Spring portion connects insertion portion to contact portion and provides tension to said contact portion against said roll T. Spring portion can be any of several springs known in the art. In the simplest embodiment, insertion portion is a wood peg that inserts in lower part of a spring, and contact portion inserts in top part of spring. Spring portion can also be rigid material with elasticity. Contact portion can curve inward terminating in a terminus. In the preferred embodiment, contact portion and insertion portion are made of wood. Pressure member portions can be made of other suitable materials, including steel, plastic, and metal, to name a few. In another embodiment, pressure member can be a peg 26, as shown in FIG. 3.

In operation, as shown in FIG. 1, and the alternative embodiment in FIG. 3, paper towel holder is placed on a surface, the base contacting the surface with the support rod extending upward, perpendicular to the base. Support rod is insertable into a paper towel roll T, and the roll T rests on the base with the rod projecting through it. Pressure member is inserted into the outermost insertion hole that is closest in proximity to the edge of the towel roll T to place pressure on the towel roll T. Spring portion of pressure member puts pressure on the body of the towel roll to keep the loose towel end of the roll from flapping free. When towels are needed, the desired length is unrolled and detached. As the size of the roll diminishes, pressure member is moved from one insertion hole to another insertion hole closer to the roll T, each move corresponding to keeping the pressure member proximal to the edge of the roll T as the diameter of the roll decreases.

Those skilled in the art will recognize that numerous modifications and changes may be made to the preferred embodiment without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the preferred embodiment is essential. Other embodiments are possible, their specific designs depending upon the particular application. As such, the scope of the invention should not be limited by the particular embodiments herein described but should be defined only by the appended claims and equivalents thereof.

I claim:

1. A paper towel holder, comprising:

a. a base provided with a central aperture and further provided with a plurality of insertion holes;

b. a support rod connected to said base at said central aperture; and c. a pressure member connected to said base by insertion into any of said plurality of insertion holes wherein the pressure member has an insertion portion for inserting into any of said insertion holes, a contact portion for contacting a towel roll, and a spring portion for maintaining pressure on the towel roll.

2. The holder of claim 1, wherein the support rod is made from wood, metal, or plastic.

3. The holder of claim 1, wherein the support rod and central aperture are threaded and the support rod screws into said central aperture.

4. The holder of claim 1, wherein the support rod is friction fitted into said central aperture.

5. The holder of claim 1, wherein the support rod is inserted into said central aperture and attached by glue, nail, bolt or screw.

6. The holder of claim 1, wherein the base is made from wood, metal, or plastic.

7. A method of holding paper towels, comprising:

a. Connecting a support rod to a flattened base wherein the base has a center and an edge, and wherein said base is provided with a plurality of insertion holes at varying distances between the center of said flattened base and the edge of said flattened base;

b. Inserting a conventional paper towel roll over and along said support rod through the hollowed core of said roll; and c. Connecting a pressure member to said flattened base, wherein said pressure member contacts said conventional paper towel roll to impede the loose unrolling of said paper towel roll and wherein the pressure member has an insertion portion for inserting into any of said insertion holes, a contact portion for contacting a towel roll, and a spring portion for maintaining pressure on the towel roll; and d. Removing said pressure member from said flattened base as said roll decreases in diameter and reconnecting said pressure member to said flattened base at an insertion hole closest in proximity to the edge of said narrowed roll.

* * * * *